US005580139A

United States Patent [19]

Grabher

[11] Patent Number: 5,580,139

[45] Date of Patent: Dec. 3, 1996

[54] DEVICE FOR FIXING A DRAWER EXTENSION MECHANISM

[75] Inventor: Karl-Heinz Grabher, Lustenau, Austria

[73] Assignee: Alfit Aktiengesellschaft, Götzis, Austria

[21] Appl. No.: 501,767

[22] Filed: Jul. 13, 1995

[30] Foreign Application Priority Data

Jul. 13, 1994 [AT] Austria ..... 1379/94

[51] Int. Cl.[6] ..... A47B 88/00; A47B 95/00

[52] U.S. Cl. ..... 312/333; 312/334.38; 312/334.5; 312/334.6

[58] Field of Search ..... 312/333, 334.1, 312/334.4, 334.6, 334.7, 334.24, 334.23, 334.27, 334.38, 334.5, 348.1, 348.2; 403/2, 105, 107

[56] References Cited

U.S. PATENT DOCUMENTS

| | | | |
|---|---|---|---|
| 4,810,045 | 3/1989 | Lautenschläger | 312/334.38 X |
| 5,015,047 | 5/1991 | Nock | 312/334.5 X |
| 5,257,861 | 11/1993 | Domenig | 312/334.5 |
| 5,281,021 | 1/1994 | Röck et al. | 403/107 X |
| 5,310,255 | 5/1994 | Ranallo | 312/334.5 |
| 5,375,923 | 12/1994 | Hall et al. | 403/2 X |
| 5,439,283 | 8/1995 | Schröder et al. | 312/334.5 X |

FOREIGN PATENT DOCUMENTS

| | | | |
|---|---|---|---|
| 3505614 | 8/1986 | Germany | 312/334.5 |
| 9204845 | 7/1992 | Germany . | |
| 9300260 | 4/1993 | Germany . | |
| 4301327 | 8/1993 | Germany | 312/334.6 |

*Primary Examiner*—James R. Brittain
*Assistant Examiner*—Rodney B. White
*Attorney, Agent, or Firm*—Collard & Roe, P.C.

[57] ABSTRACT

A device for releasably fixing a guide rail of a drawer slide to a drawer, the guide rail extending in a longitudinal direction and having a support surface for the drawer, the guide rail defining an opening, comprises an integral shaped part comprising a base plate mountable on the drawer, a detent engageable by the guide rail opening, a hand grip attached to the detent, an adjustment wedge connected to the base plate by breakable connecting portions, the wedge being adjustable in the longitudinal direction for insertion between the support surface of the guide rail and the drawer for positioning the drawer in a desired position in which the detent engages the opening and the hand grip being operable to release the detent from the opening, elastically flexible webs connecting the detent and the hand grip to the base plate, and guides for guiding the adjustment wedge in the longitudinal direction upon breaking the breakable connecting portions, the adjustment wedge having a dog lockingly engaging the guides.

4 Claims, 3 Drawing Sheets

DEVICE FOR FIXING A DRAWER EXTENSION MECHANISM

BACKGROUND OF THE INVENTION

1. Field of the Invention

The present invention relates to a device for releasably fixing a guide rail of a drawer slide to a drawer, the guide rail extending in a longitudinal direction and having a support surface for the drawer, the guide rail defining an opening, which comprises a base plate mountable on the drawer.

2. Description of the Prior Art

Known devices of this type comprise a detent engageable by the guide rail opening, a hand grip attached to the detent, and an adjustment wedge connected to the base plate and adjustable in the longitudinal direction for insertion between the support surface of the guide rail and the drawer for positioning the drawer in a desired position in which the detent engages the opening and the hand grip being operable to release the detent from the opening. Such devices are usually mounted at the front end of the drawer bottom and behind a front plate of the drawer. They enable the drawer to be released from the guide rail and thus from the slide mechanism which enables the drawer to be pulled out and retracted, in cooperation with a snap connection attaching a rear end of the guide rail with the drawer or with a hook on the guide rail engaging an opening in the drawer bottom. In this way, the drawer may be separated from the slide mechanism and may be used by itself, and drawer slide mechanisms may be used in which the guide rails and their guides cannot be simply separated. It thus becomes possible to fix the drawer slide mechanism in the corpus and then to attach the drawer thereto. Preferably, such devices are arranged mirror-symmetrically at the left and right sides of the drawer.

A multi-part structure of this type has been disclosed in German utility model No. 9,204,845, whose registration was published on Jul. 30, 1992. This device comprises a number of parts, including a base plate usually made of sheet metal and a guide housing for a detent and guides for an adjustment wedge, with the necessary holes for fixing screws. The pivotal detent is mounted on the base plate in the guide housing and is supported with its free end in the guide housing. This is necessary because the vertical pivoting axis of the detent must be transversely spaced from the guide rail to be attached so that a pull on the drawer causes pivoting of the detent and could cause the detent to be disengaged from the guide rail. A separate synthetic resin spring biases the detent into the locking position, and the detent is released by a separately mounted hand grip. The adjustment wedge may be adjusted by a Phillips screw driver engaging a rack of its guide. The positioning of the adjustment wedge relative to the base plate is not accurately defined, which means that the adjustment wedge for assembling of the guide rail with the drawer is adjusted according to the individual need, being held in position between the drawer bottom and the support surface of the guide rail only by the wedging effect. Each removal of the drawer from the slide mechanism then requires a new individual adjustment, which causes difficulties for unskilled users. In addition, the many parts of the device involve high manufacturing costs, and each assembly involves a number of adjustments before the assembly of the guide rail and the drawer can be completed.

In the device of German utility model No. 9,300,260, whose registration was published on Apr. 15, 1993, the base plate forms an integral shaped part of synthetic resin with the detent, the hand grip and the adjustment wedge. The detent and the hand grip as well as the adjustment wedge are connected to the base plate by elastically flexible webs, the detent with its web and the adjustment wedge being arranged sequentially in the longitudinal direction of the guide rail, and the guide rail abutting a mounting flange of the base plate for the front plate of the drawer, which mounting flange rises from the base plate and laterally protrudes from the detent arrangement. The detent engages the guide rail near the mounting flange. Accordingly, the adjustment wedge is arranged at a substantial distance from the front plate of the drawer and the detent, and may be pivotally pressed between the drawer bottom and the guide rail about its connecting webs from the same side as the detent. To secure the adjustment wedge in different engagement positions, it may have protruding stops for cooperation with stops protruding from a vertical portion of the base plate.

This device has a number of disadvantages. First, the actuation of the detent on the protruding portion of the adjustment wedge and its engagement may cause an undesired movement of the adjustment wedge. The lateral insertion of the adjustment wedge subjects the guide rail to an undesirable bending load, which brings with it the danger that the detent becomes disengaged, and the wedging load is effective essentially only along a linear contact. It is not possible simply to release the detent from the guide rail, to remove the drawer and then to attach it again. Rather, before this attachment, the adjustment wedge must be re-set from the possible engagement position with the guide rail, the engagement must be effected and finally the drawer must be properly adjusted by laterally inserting the adjustment wedge, which produces the above-mentioned disadvantages and causes considerable difficulties for the unskilled user.

SUMMARY OF THE INVENTION

It is the primary object of this invention to provide a device of the first-described type which is simple to manufacture, dependable in operation, requires no additional adjustments for assembly, except for wedge adjustment required for possible vertical adjustment, and retains a selected wedge adjustment after removal of the drawer, without the adjustment wedge exerting undesirable bending and torsion forces on the guide rail for the drawer.

This and other objects are accomplished by the invention with a device which comprises a base plate mountable on the drawer, the base plate being an integral shaped part comprising a detent engageable by the guide rail opening, a hand grip attached to the detent, an adjustment wedge connected to the base plate by a breakable connecting portion, the wedge being adjustable in the longitudinal direction for insertion between the support surface of the guide rail and the drawer for positioning the drawer in a desired position in which the detent engages the opening and the hand grip being operable to release the detent from the opening, elastically flexible webs connecting the detent and the hand grip to the base plate, and guide means for guiding the adjustment wedge in the longitudinal direction upon breaking the breakable connecting portion, the adjustment wedge having a dog lockingly engaging the guide means.

Such an integral shaped part overcomes all the indicated disadvantages and meets the necessary operational requirements for being mounted on the drawer with a properly positioned adjustment wedge, the adjustment wedge adjustable in the longitudinal direction of the guide rail and therefore causing no lateral deflection forces upon the guide rail and its adjustment being retained after the drawer has been removed from the drawer slide mechanism so that a newly assembled drawer is correctly adjusted. Once the proper form has been made, the integral shaped part can be cheaply mass-produced by injection molding.

According to a preferred embodiment, the detent comprises a thickened shank arranged to engage and contact the guide rail, one of the elastically flexible webs extending substantially parallel to the guide rail when the detent engages the guide rail opening and leading from the shank to a holding head merging with the base plate, the hand grip is stiffer than the webs and extends from the one web at an acute angle beyond the holding head, and the hand grip is connected to another holding head merging with the base plate by the other elastically flexible web which leads back from the hand grip to the other web and may be substantially S-shaped. This securely prevents a disengagement of the detent in the presence of pulling forces or impacts on the drawer. Since the detent and the one web are guided along the guide rail and an extension of the outside thereof, no torsion is exerted upon the detent when a pulling force is exerted in the longitudinal direction so that the detent remains securely engaged and can be released only by actuation of the hand grip. This release by pressure on the hand grip is made easy by the particular arrangement of the hand grip and the flexible connecting webs.

The integral shaped part may further comprise a protective hood extending from the base plate over a displacement path of the detent. This will prevent dirt from entering and will also assure that the connection between drawer and guide rail is not released by actuation of the detent when the device is mounted on the drawer bottom, at which time the device is not visible and the work must be done substantially by feel.

Preferably, the adjustment wedge comprises a rack extending along a side of the wedge in the longitudinal direction, the rack having teeth defining recesses therebetween, the base plate defines an insertion guide for a tool designed to engage a respective one of the recesses, and said wedge side partially covers the insertion guide when the wedge side is positioned above the breakable portion whereby insertion of the tool in the insertion guide and breaking of the breakable portion by the tool causes the adjustment wedge to be displaced toward a side of the wedge facing away from the rack into alignment with the guide means and a dog on the wedge engages the guide means. Such a structure assures not only a dependable operation of the adjustment wedge but also has the great advantage that the contours of the adjustment wedge may be relatively simply shaped, in that the wedge is first positioned in an opening of the base plate and is then guided along the guide means in the base plate for use. Until the breakable portion is broken, the adjustment wedge is nevertheless secured positioned and connected to the base plate and the rest of the device in its correct position.

The manufacture may be simplified if the guide means comprises two lateral guides for the adjustment wedge, the guides being open to an assembly surface of the base plate. Since the adjustment wedge is disconnected only after the device has been mounted, the drawer bottom or wall of the drawer on which the base plate is mounted constitutes with the base plate the guide for the adjustment wedge, which is clamped under the guide rail when adjusted.

Preferably, one of the lateral guides is arranged for guiding the wedge side facing away from the rack, the dog is arranged in front of the rack in the longitudinal direction, the dog protruding beyond an opening in the other lateral guide in the position of the wedge fixed by the breakable portions and the dog having a wedge-shaped front face which, upon adjustment of the wedge in the longitudinal direction, causes an elastic deformation and pressing of the wedge against the one lateral guide while guiding the wedge into alignment with the other lateral guide. This structure produces a forced guide so that the person assembling the device with the drawer needs to watch only the adjustment of the wedge for properly positioning the drawer after the adjustment wedge has been disconnected. The wedge may be adjusted along the longitudinal direction without any difficulty and may be secured in every adjusted position.

Finally, the device may further comprise a rising access wedge at a rear end of the adjustment wedge, the access wedge being accessible through an elongated slot to another guide rail of the drawer slide, and a stationary guide dog on the base plate for upwardly bending the access wedge away from the base plate upon adjustment of the adjustment wedge in the longitudinal direction. This enables the rising wedge to be bent upwardly in response to the insertion of the adjustment wedge between the drawer bottom and the guide rail so that the rising wedge is always positioned at the level of the end of a guide rail to be received. It is not necessary for the guide rail to reach to the front plate of the drawer.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF THE PREFERRED EMBODIMENT

Figure 1:
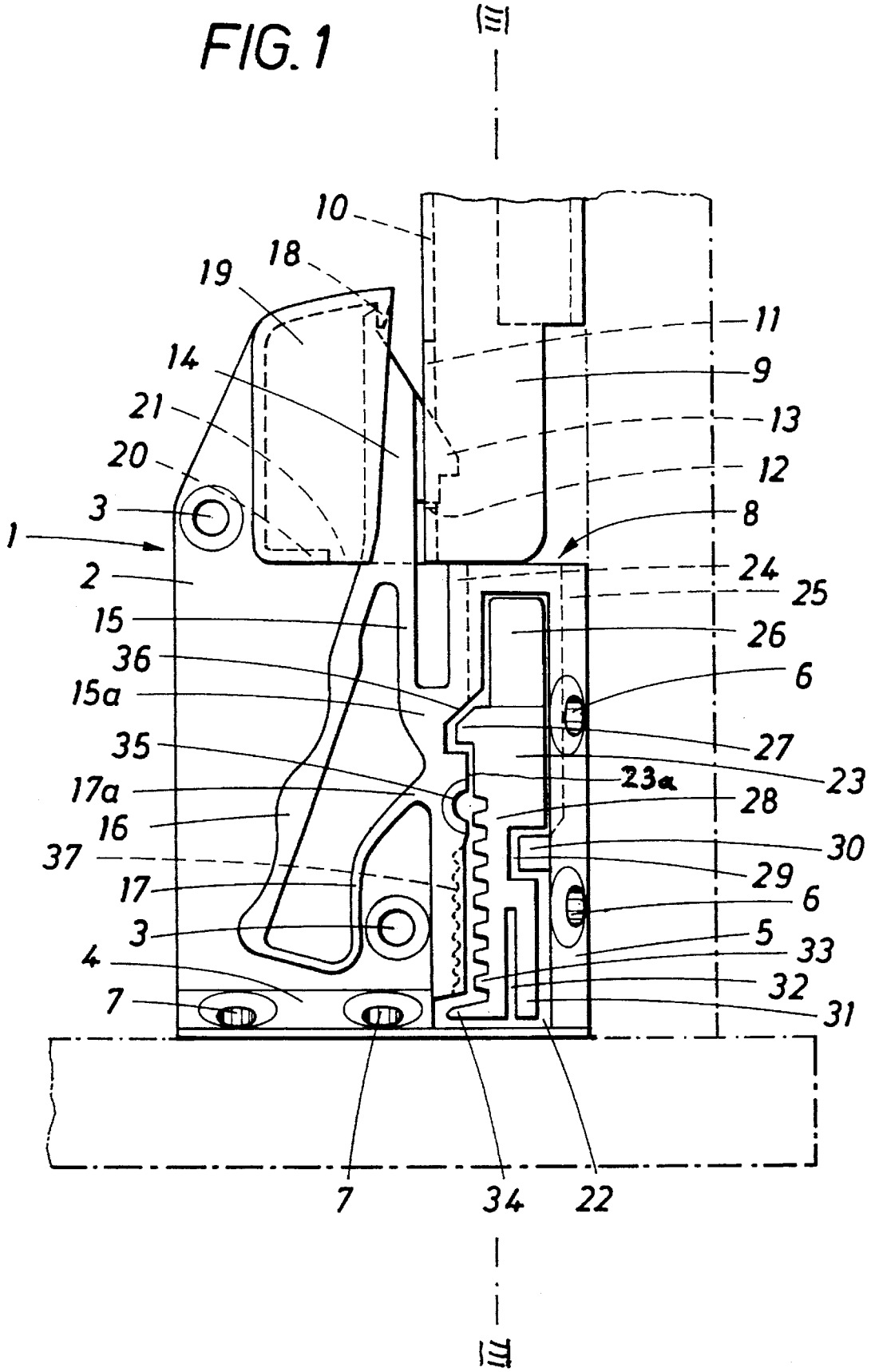
FIG. 1 shows a plan view of the device, viewed from below, together with an end of a guide rail.

The drawing illustrates a device for releasably fixing guide rail 9 of a drawer slide to a drawer. The guide rail extends in a longitudinal direction and has a support surface for the drawer and defines opening 11. The device comprises integral shaped part 1 comprising base plate 2 mountable on the drawer, which is injection molded from an elastic synthetic resin. The base plate has threaded holes 3 enabling it to be screwed to the bottom of a drawer. Two abutting edges of the base plate have flanges 4, 5 defining additional threaded holes 6, 7 for affixing base plate 2 to a side wall of the drawer projecting below the drawer bottom and to the front plate of the drawer. Rectangular slot 8 is provided at an end of the device for receiving an end of guide rail 9 of a drawer slide mechanism. Such mechanisms are well known and are, therefore, not described herein.

The integral shaped part comprises detent 13 engageable by opening 11 in side flange 10 of guide rail 9, edge 12 of the guide rail opening which is adjacent the device forming a rest for the hook of detent 13. The integral shaped part further comprises hand grip 16 attached to the detent and adjustment wedge 23 connected to base plate 2 by breakable connecting portion. The wedge is adjustable in the longitudinal direction for insertion between the support surface of guide rail 9 and the drawer for positioning the drawer in a desired position in which detent 13 engages opening 11 and hand grip 16 is operable to release the detent from the opening. Elastically flexible webs 15, 17 connect detent 13 and hand grip 16 to base plate 2. Guides 24, 25 are provided for guiding adjustment wedge 23 in the longitudinal direction upon breaking the breakable connecting portion, and adjustment wedge 23 has dog 27 lockingly engaging the guides.

Detent 13 comprises thickened shank 14 arranged to engage and contact the guide rail and elastically flexible web 15, separated from base plate 2 by a horizontal gap, extends substantially parallel to guide rail 9 when detent 13 engages guide rail opening 11 and leads from shank 14 to holding head 15*a* merging with the base plate. Hand grip 16 is stiffer than webs 15, 17 and extends from web 15 at an acute angle beyond holding head 15*a*, and the hand grip is connected to holding head 17*a* merging with the base plate by elastically flexible web 17 which is substantially S-shaped and leads back from the hand grip to web 15. The holding heads project from the base plate and may be merged into a single head.

It is not advantageous to shape parts 13–17 in the form shown in FIG. 1 but in a shape in which detent 13 projects during the injection molding beyond rectangular slot 8 and is formed adjacent the edge of slot 8 separated therefrom by a gap, web 15 being partially bent over slot 8 and web 17 having less of a curvature. In the illustrated position, detent hook 13 is secured in position by stop 18. This stop is provided at the end of a protective hood 19 extending from base plate 2 over a displacement path of detent 13 when the detent is pivoted by hand grip 16. Hood 19 is shaped from the base plate and is open towards the drawer bottom. Side wall 20 of protective hood 19 defines opening 21 facing hand grip 16 to allow detent 13 with its shank 14 to pivot along a displacement path between its engaged and released positions.

Base plate 2 defines opening 22 adjacent holding head 15*a*, 17*a* to accommodate adjustment wedge 23 which is integral with the base plate but is connected thereto by breakable portion. The adjustment wedge comprises rack body 28 having rack 33 extending along a side of the wedge in the longitudinal direction, the rack having teeth defining recesses therebetween. The base plate defines an insertion guide 35 for a tool designed to engage a respective one of the recesses, such as a Phillips screwdriver, and this wedge side partially covers the insertion guide when the wedge side is positioned above the breakable portion whereby insertion of the tool in insertion guide 35 and breaking of the breakable portion by the tool causes adjustment wedge 23 to be displaced toward a side of the wedge facing away from rack 33 into alignment with the guide means 24, 25 and dog 27 on wedge 23 engages the guide means.

The illustrated guide means comprises two lateral guides 24, 25 for adjustment wedge 23, the guides being open to an assembly surface of the base plate. Lateral guide 25 is arranged for guiding the wedge side facing away from rack 33, the dog is arranged in front of the rack in the longitudinal direction and protrudes beyond an opening in lateral guide 24 in the position of the wedge fixed by the breakable portion. The dog 27 has a wedge-shaped front face 36 matingly abutting the opening in lateral guide 24 and which, upon adjustment of wedge 23 in the longitudinal direction, causes an elastic deformation and pressing of the wedge against lateral guide 25 while guiding the wedge into alignment with lateral guide 24.

Adjustment wedge 23 fits between lateral guides 24, 25, which protrude from base plate 2, and is of the same height as the lateral guides so that it is positioned below the edge of base plate recess 22 provided in the base plate for the adjustment wedge. Lateral guides 24, 25 are open towards the drawer bottom and opening 8. The adjustment wedge has a wedge body 26 at its front end, an intermediate portion carrying dog 27 and an end portion 28 carrying rack 33. End portion 28 of adjustment wedge 23 defines recess 29 add guide dog 30 is engaged in this recess.

Rising access slope 31 at a rear end of the adjustment wedge is accessible through elongated slot 32 to another guide rail of the drawer slide, and stationary guide dog 30 on the base plate is arranged for upwardly bending the access wedge 31 away from base plate 2 upon adjustment of the adjustment wedge in the longitudinal direction.

Rack 33 opposite recess 29 extends in the longitudinal direction along end portion 28 and has an elastic stop finger 34. In the position shown in FIG. 1, rack 33 forms a diagonal to semi-circular insertion opening 35 to enable a suitable tool, for example a Phillips screwdriver, to be inserted.

In operation, the drawer on which two devices of the present invention have been mirror-symmetrically mounted at each side is moved into the corpus until detent hooks 13 have engaged guide rail openings 11. If a vertical adjustment of the drawer relative to guide rails 9 is desired, a Phillips screwdriver is inserted through opening 35 and pressed down. This causes adjustment wedge 23 to be broken away from the base plate and to be displaced to the right, as seen in the drawing. If the screwdriver is now rotated counter-clockwise, rack 33 causes wedge body 26 of the adjustment wedge to be displaced outwardly, dog 27 engaging mating abutment 36 and assuring that the right side of wedge 23 is pressed against lateral guide 25 while dog 27 finally engages lateral guide 24, as shown in FIG. 2.

Figure 2:
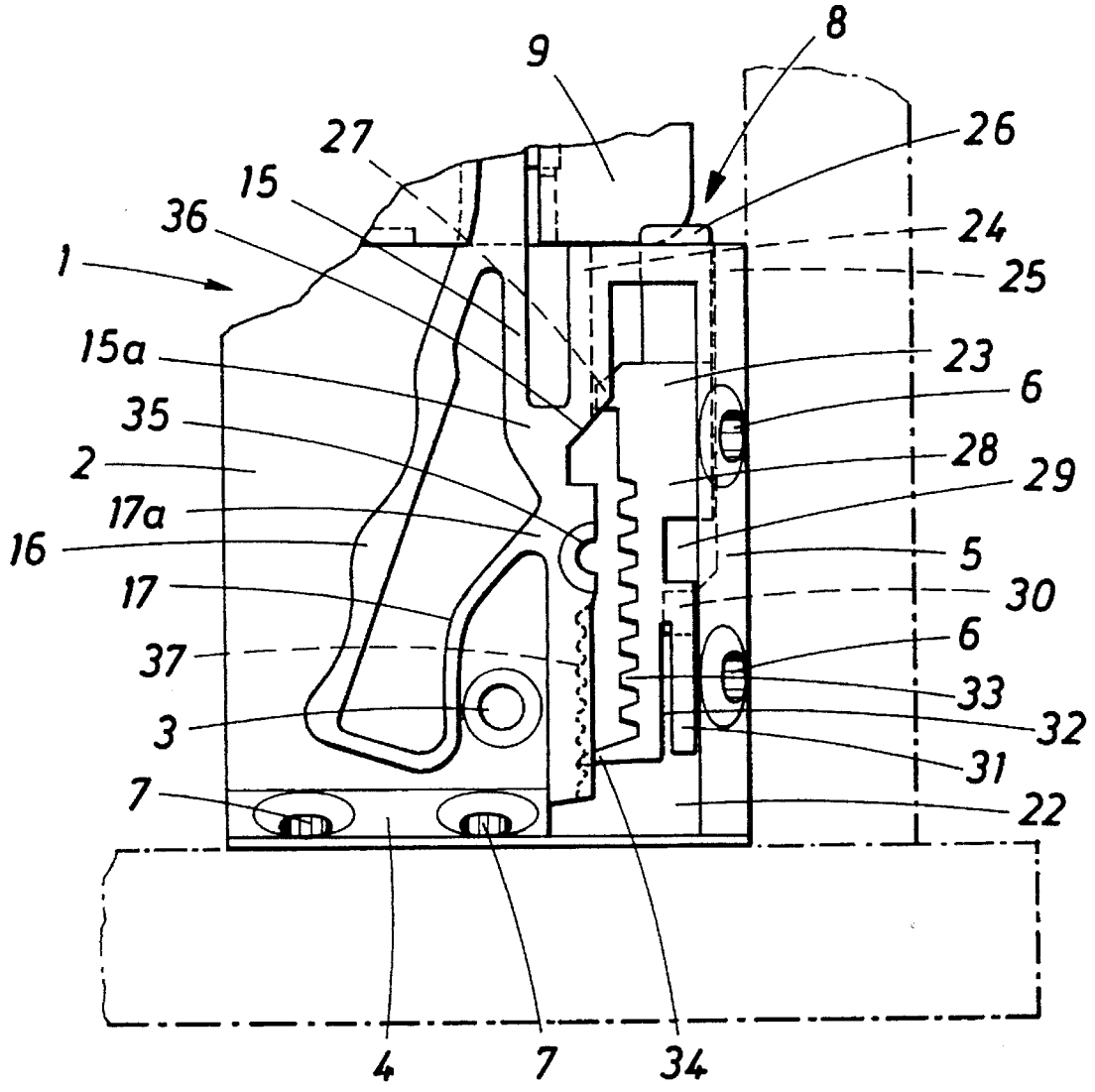
FIG. 2 is a like view, showing the adjustment wedge partially extended from the device toward the guide rail.
Figure 3:
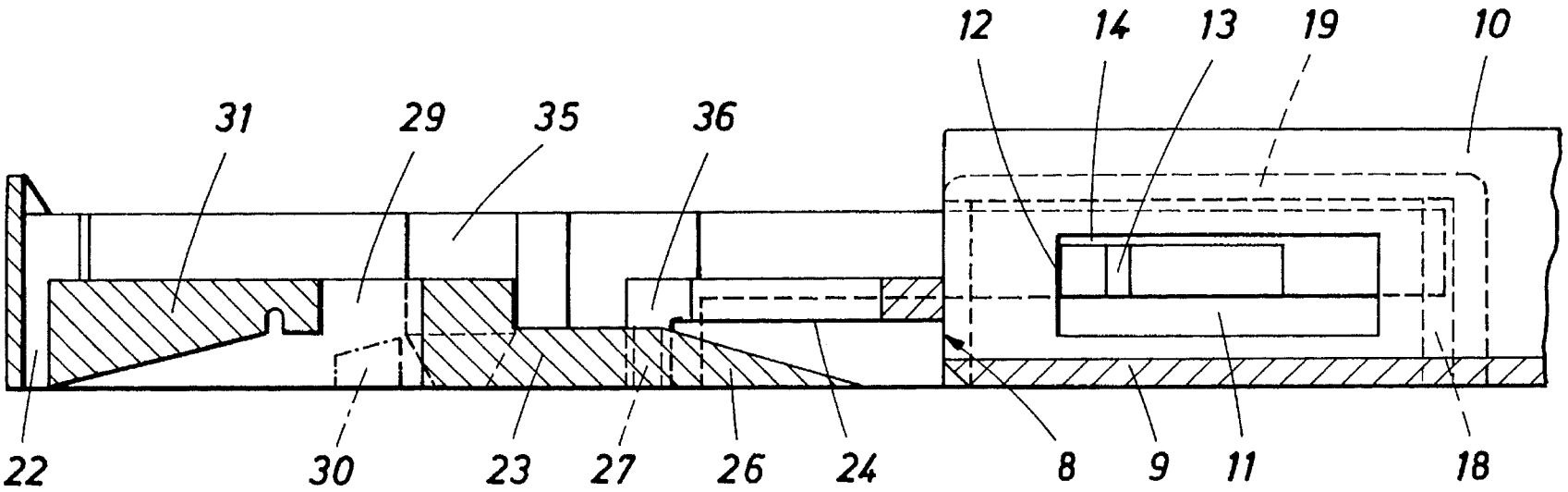
FIG.3 is a section along line III—III of FIG. 1.

FIG. 2 illustrates wedge body 26 in a possible engagement with guide rail 9. It is inserted between the drawer bottom and the guide rail and raises the drawer so that the front plate of the drawer may be adjusted to define the correct gap width. Elastic stop finger 34 engages guide notches 37 so that adjustment wedge 23 is secured in every position.

As the adjustment wedge is further displaced, rising slope 31 moves over god 30 and is bent upwardly away from the drawer bottom so that this rising slope may be engaged by a guide rail following guide rail 9 when the drawer is adjusted vertically with respect to guide rail 9.

What is claimed is:

1. A device for releasably fixing a guide rail of a drawer slide to a drawer, the guide rail extending in a longitudinal direction and having a support surface for the drawer, the guide rail defining an opening, which comprises an integral shaped part comprising (a) a base plate mountable on the drawer, (b) a detent engageable by the guide rail opening, (c) a hand grip attached to the detent, (d) an adjustment wedge connected to the base plate by a breakable connecting portion, the wedge being adjustable in the longitudinal direction for insertion between the support surface of the guide rail and the drawer for positioning the drawer in a desired position in which the detent engages the opening and the hand grip being operable to release the detent from the opening, the adjustment wedge comprising (1) a rack extending along a side of the wedge in the longitudinal direction, the rack having teeth defining recesses there between, (e) elastically flexible webs connecting the detent and the hand grip to the base plate, (f) guide means for guiding the adjustment wedge in the longitudinal direction upon breaking the breakable connecting portions, the adjustment wedge having a dog lockingly engaging the guide means.

(g) the base plate defining an insertion guide for a tool designed to engage a respective one of the recesses, and said wedge side partially covering the insertion guide when the wedge side is positioned above the breakable portion whereby insertion of the tool in the insertion guide and breaking of the breakable portion by the tool causes the adjustment wedge to be displaced toward a side of the wedge facing away from the rack into alignment with the guide means, and (g) a dog on the wedge engaging the guide means.

2. The device of claim 1, wherein the guide means comprises two lateral guides for the adjustment wedge, the guides being open to an assembly surface of the base plate.

3. The device of claim 2, wherein one of the lateral guides is arranged for guiding the wedge side facing away from the rack, the dog is arranged in front of the rack in the longitudinal direction, the dog protruding beyond an opening in the other lateral guide in the position of the wedge fixed by the breakable portions and the dog having a wedge-shaped front face which, upon adjustment of the wedge in the longitudinal direction, causes an elastic deformation and pressing of the wedge against the one lateral guide while guiding the wedge into alignment with the other lateral guide.

4. The device of claim 1, further comprising a rising access wedge at a rear end of the adjustment wedge, the access wedge being accessible through an elongated slot to another guide rail of the drawer slide, and a stationary guide dog on the base plate for upwardly bending the access wedge away from the base plate upon adjustment of the adjustment wedge in the longitudinal direction.

* * * * *